United States Patent [19]

Vogtherr

[11] 4,131,315

[45] Dec. 26, 1978

[54] CHAIR WITH DEFORMABLE ARMREST

[75] Inventor: Burkhard Vogtherr, Kandern, Fed. Rep. of Germany

[73] Assignee: Firma Drabert Sohne, Minden, Fed. Rep. of Germany

[21] Appl. No.: 837,793

[22] Filed: Sep. 29, 1977

[51] Int. Cl.[2] ..... A47C 3/00
[52] U.S. Cl. ..... 297/286; 297/421
[58] Field of Search ..... 297/286–290, 297/354, 355, 421

[56] References Cited

U.S. PATENT DOCUMENTS

| | | | |
|---|---|---|---|
| 2,218,863 | 10/1940 | Wagner | 297/288 |
| 3,083,999 | 4/1963 | Silva | 297/286 |

*Primary Examiner*—James C. Mitchell
*Attorney, Agent, or Firm*—Pollock, Vande Sande & Priddy

[57] ABSTRACT

A chair or other article of furniture for sitting such as a stool or sofa with at least one armrest which is connected to the backrest portion and to the seat portion. The backrest portion of the chair can be reclined, and the armrest is deformable according to the inclination of the backrest portion of the chair.

3 Claims, 8 Drawing Figures

CHAIR WITH DEFORMABLE ARMREST

BACKGROUND OF THE INVENTION

In a well known design for a chair with a reclining backrest, an armrest consists of at least two parts, a vertical portion and a horizontal portion. The vertical portion is attached to the seat portion of the chair at its lower end and to the front of the horizontal portion at its upper end. The horizontal portion is attached to the vertical portion at its front end and to the backrest of the chair at its back end. At the intersection of the vertical portion and the horizontal portion, the armrest can be adjusted in accordance with the inclination of the backrest portion of the chair by a series of slots on the underside of the horizontal portion of the armrest which mate with a protuberance on the end of a support member. A design such as this is used primarily in folding or patio chairs and is unsuitable for more elegant chair designs.

In another design for a chair with a reclinable backrest, the vertical portion of the armrest is fixedly attached to the chair seat at its lower end. In this design, a gap develops between the back of the horizontal portion of the armrest and the backrest of the chair when the backrest of the chair is reclined. If the horizontal portion of the armrest is of sufficient length to prevent such a gap, then the horizontal portion must necessarily protrude from the back of the chair when the back of the chair is in its upright position.

In a further prior art design, the horizontal portion of the armrest is fixedly attached to the backrest of the chair at its back end. The disadvantage to this design is that the armrest is raised at its front end upon the reclining of the backrest of the chair.

OBJECTS OF THE INVENTION

It is the object of the present invention to provide a chair or other article of furniture for sitting with a reclining backrest and at least one armrest which avoids the disadvantages of the prior art designs. The chair of the present invention is designed to be aesthetically pleasing so as to be utilized in elegant surroundings such as homes or offices.

SUMMARY OF THE INVENTION

The chair of the present invention is provided with at least one armrest of elastically deformable material in which is embedded a stiffening insert. The stiffening insert may be rigid in sections and deformable in sections, or may be elastically deformable over its entire length. In one embodiment of the present invention, the stiffening inserts may be partially visible and incorporated into the general design of the chair.

BRIEF DESCRIPTION OF THE DRAWINGS

In describing this invention, reference will be made to the accompanying drawings in which.

DETAILED DESCRIPTION OF THE PREFERRED EMBODIMENTS

Figure 1:
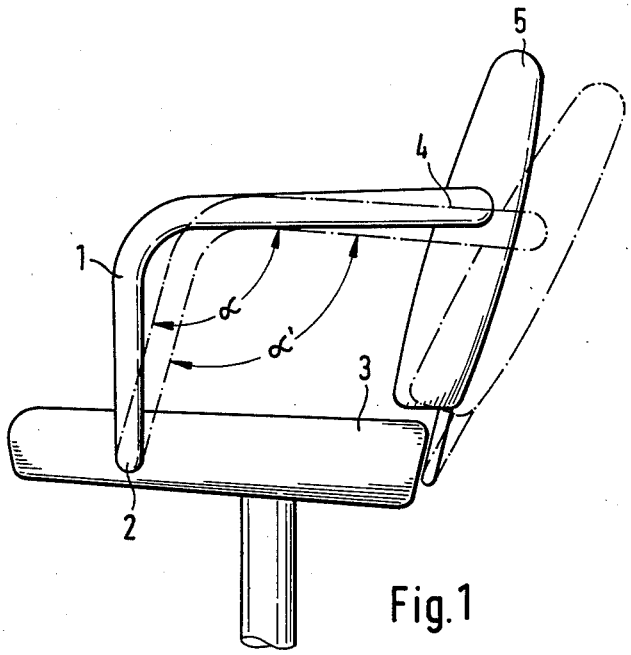
FIG. 1 is a side view of the upper part of a chair of the present invention with the chair in a reclined position being illustrated in dotted line form.

As shown in FIG. 1, armrest 1 is pivotally connected to seat 3 at point 2 and to backrest 5 at point 4. When backrest 5 is in its upright position, angle $\alpha$ is formed between the primarily verticle and the primarily horizontal portions of armrest 1. When backrest 5 is inclined, angle $\alpha'$ is formed between the verticle and horizontal portions of armrest 1 as shown in dotted line form in FIG. 1.

Figure 2:
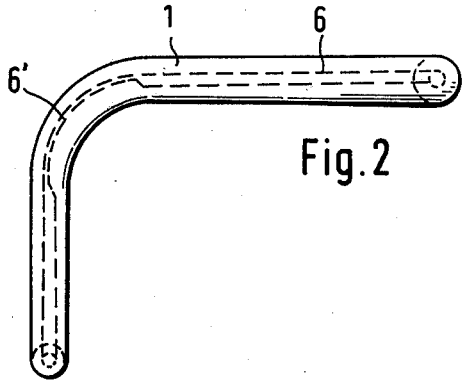
FIG. 2 is a side view of an armrest of the chair of FIG. 1.

Armrest 1 (FIG. 2) is constructed of deformable material in which is embedded a stiffening insert 6 which is rigid in sections and elastically deformable at its arc 6'. When backrest 5 is inclined as shown in FIG. 1, section 6' of stiffening insert 6 (FIG. 2) is deformed while the adjoining sections of stiffening insert 6 remain rigid.

Figure 3:
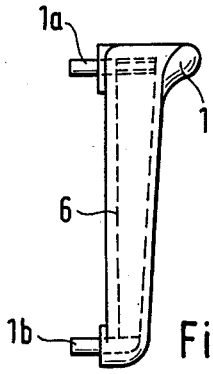
FIG. 3 is a front view of an armrest of the chair of FIG. 1.
Figure 4:
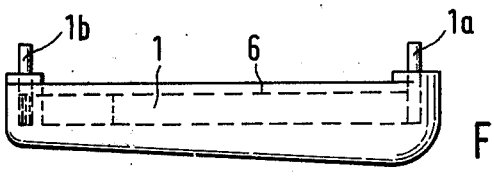
FIG. 4 is a top view of an armrest of the chair of FIG. 1.

As illustrated in FIGS. 3 and 4, stiffening insert 6 has joint pins 1*a* and 1*b* which are utilized to connect armrest 1 with backrest 5 at point 4, and seat 3 at point 2, respectively.

Figure 5:
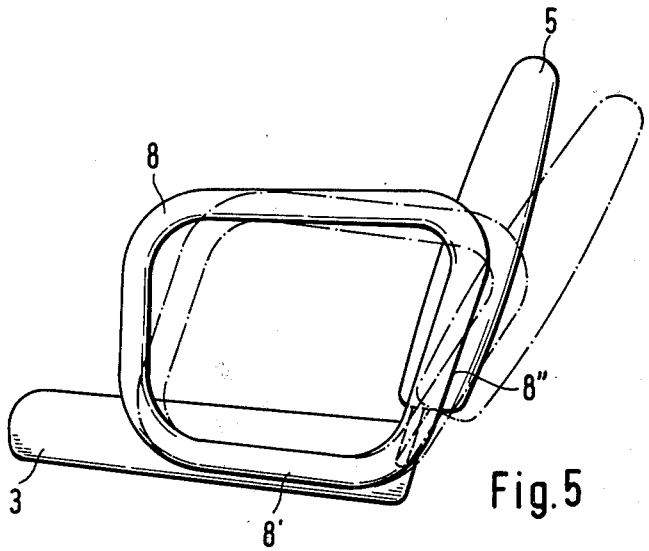
FIG. 5 is a side view of the upper part of a chair illustrating a further embodiment of the present invention, with the chair in a reclined position being illustrated in dotted line form.
Figure 6:
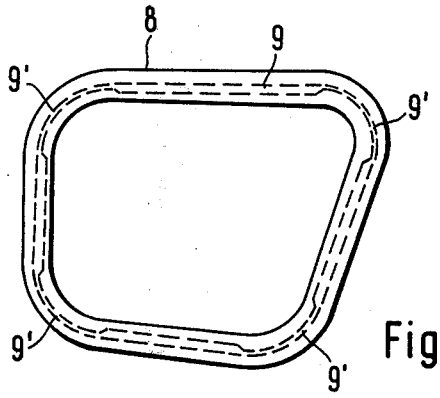
FIG. 6 is a side view of the armrest of the chair of FIG. 5.

In the embodiment of the present invention shown in FIG. 5, armrest 8 consists of a closed frame. Lower frame part 8' is attached to seat 3, and rear frame part 8" is attached to backrest 5 by means of joint pins (not shown). Stiffening insert 9 as shown in FIG. 6 is rigid except at arc portions 9' where stiffening insert 9 is elastically deformable.

Figure 7:
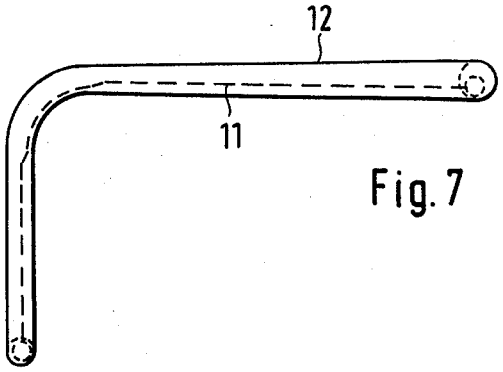
FIG. 7 is a side view of an armrest of a further embodiment of the present invention.
Figure 8:
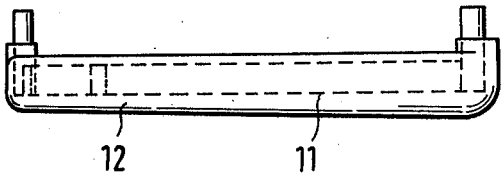
FIG. 8 is a top view of the armrest of FIG. 7.

In the embodiment shown in FIGS. 7 and 8, armrest 12 is so constructed that stiffening insert 11 is only partially enclosed by the elastically deformable material of the armrest. Stiffening insert 11 is thus partially visible and is incorporated into the design of the chair of this embodiment.

All of the various embodiments described above may be constructed with a stiffening insert which is elastically deformable over its entire lenth, and are not limited to designs in which the stiffening insert is elastically deformable only at the arc portions of the armrest.

The chair of the present invention in any of its embodiments provides a reclining backrest and at least one armrest portion which is elastically deformable according to the inclination of the backrest portion. The chair of the present invention provides the above-mentioned features without encountering the usual disadvantages of chairs known in the art which feature reclining backrests, i.e., complex hardware, unlevel armrest portions when the back of the chair is in its reclined position, and spacing between the armrest and the backrest portions of the chair when the chair is in its reclined position.

What is claimed is:

1. A chair or other article of furniture for sitting comprising:

a seat, a reclinable backrest portion pivotally connected to said seat, at least one armrest member being integrally formed of a generally horizontal portion pivotally secured to said backrest portion and a generally vertical portion pivotally secured to said seat, both said horizontal and vertical portions of said armrest member being substantially rigid, said armrest member having a further arcuate portion which joins said vertical and horizontal portions and is bendable to permit variation of the angle of inclination of said backrest portion relative to said seat by deformation of said arcuate portion while permitting said horizontal and vertical portions to remain essentially straight.

2. The chair of claim 1 in which said horizontal, vertical, and arcuate portions of said integrally formed armrest portion are at least partially embedded within a deformable material.

3. The chair of claim 1 in which said armrest portion is of generally rectangular configuration having a pair of opposed horizontal portions and a pair of opposed vertical portions and an arcuate portion at each corner of said member.

* * * * *

UNITED STATES PATENT AND TRADEMARK OFFICE

CERTIFICATE OF CORRECTION

PATENT NO. : 4,131,315
DATED : December 26, 1978
INVENTOR(S) : BURKHARD VOGTHERR It is certified that error appears in the above-identified patent and that said Letters Patent are hereby corrected as shown below:

Foreign Application Priority Data

April 16, 1977 Germany. . . . . 7712928

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*